US005651349A

United States Patent [19]

Dykstra et al.

[11] Patent Number: 5,651,349

[45] Date of Patent: Jul. 29, 1997

[54] PURGE SYSTEM FLOW MONITOR AND METHOD

[75] Inventors: Gregory J. Dykstra, Grosse Pointe Woods; Mark E. Hope, Ann Arbor; Kim M. Person, Southfield, all of Mich.; John E. Letcher, Glendale, Ariz.; James M. Witalec, Brighton, Mich.

[73] Assignee: Chrysler Corporation, Auburn Hills, Mich.

[21] Appl. No.: 570,219

[22] Filed: Dec. 11, 1995

[51] Int. Cl.[6] ..... F02M 33/02

[52] U.S. Cl. ..... 123/520; 123/198 D

[58] Field of Search ..... 123/520, 198 D, 123/519, 516, 518, 521

[56] References Cited

U.S. PATENT DOCUMENTS

| | | | |
|---|---|---|---|
| 4,949,695 | 8/1990 | Uranishi | 123/198 D |
| 5,085,194 | 2/1992 | Kuroda | 123/198 D |
| 5,105,789 | 4/1992 | Aramaki | 123/198 D |
| 5,230,319 | 7/1993 | Otsuka | 123/198 D |
| 5,245,973 | 9/1993 | Otsuka | 123/198 D |
| 5,297,527 | 3/1994 | Suzuki | 123/198 D |
| 5,488,936 | 2/1996 | Rychlick | 123/198 D |

*Primary Examiner*—Carl S. Miller

*Attorney, Agent, or Firm*—Mark P. Calcaterra

[57] ABSTRACT

A system and method of monitoring the purge flow in an evaporative emission control purge system of a motor vehicle. Signals indicative of engine speed, fuel control and automatic idle speed position are measured and used to determine whether the purge flow system is operating properly. With purge flow activated, the amount of purge flow is increased in accordance with a ramping rate and the measured signals are monitored to determine whether or not a change occurs in any one of the engine speed, fuel control and AIS position signals.

14 Claims, 2 Drawing Sheets

PURGE SYSTEM FLOW MONITOR AND METHOD

BACKGROUND OF THE INVENTION

1. Technical Field

The present invention relates generally to motor vehicle evaporative emission control systems and, more particularly, to a system and method of monitoring for the presence of purge flow in a purge system for evaporative emission control in a motor vehicle.

2. Discussion

In recent years, motor vehicle manufacturers have greatly reduced the levels of hydrocarbons, e.g., carbon monoxide, carbon dioxide, etc., and other gasoline and diesel powered motor vehicle emissions in response to increased governmental regulations aimed at preserving and protecting the environment. In addition to the commonly known tailpipe emissions, i.e., the exhaust gases generally produced during the combustion process of the motor vehicle engine, there are also evaporative emissions. That is, a motor vehicle produces emissions while simply sitting parked due to evaporation of oil, fuel and other fluids which are common to motor vehicles.

Governmental regulations such as those promulgated by the Federal Environmental Protection Agency (EPA) and the California Air Resource Board (CARB) often establish strict limitations on the amount of emissions, both exhaust gas and evaporative, that a motor vehicle may produce. Modern day regulations also require that a motor vehicle manufacturer test and certify that the vehicles manufactured and sold conform to these regulations. The allowable amounts of emissions are often measured as parts per million (ppm) of a total sample of air collected.

In this regard, modern motor vehicles incorporate sealed fuel and lubrication systems which commonly include charcoal canisters and the like for collecting vapors produced as a result of the evaporation of hydrocarbon based fluids. The conventional sealed fuel and lubrication systems typically retain the vapors for later burning in the vehicle engine when the vehicle engine is running. Any vapors not collected by such systems and emitted from the motor vehicle into the environment are generally classified as evaporative emissions.

In particular, evaporative emission control (EEC) systems prevent the escape of gasoline vapors from the fuel tank and carburetor, whether or not the engine is running. Such evaporative emission control systems commonly utilize an activated charcoal canister to trap the vapors. Modern automotive purge systems commonly employ an electronic controlled solenoid valve which permits manifold vacuum to purge evaporated emissions from the charcoal canister. On restarting of the engine, a purge system causes a flow of filtered air through the canister to purge vapors from the charcoal canister. The air flow mixture of air and vapors then generally passes through one or more tubes leading to the engine for burning in the engine.

Current and future proposed regulatory requirements include a rational check of the purge system flow to determine if the purge system is functioning properly as required. In order to meet the evaporative regulatory standards, a purge system flow monitor is needed to monitor and test the operation of the purge system. In the past, some flow monitor systems provided a rationality check of the electronic controlled solenoid valve. This type of test has generally been limited to determining whether the electronic controlled solenoid valve is electrically energized or deenergized. Other proposed purge monitor systems may require additional emissions system hardware. However, the use of additional hardware adds to the overall cost and complexity of the purge system.

It is therefore one object of the present invention to provide for a system and method for monitoring purge flow to insure that a purge flow system is operating properly.

Another object of the present invention is to provide for a flow monitor system and method of monitoring evaporative emission control purge flow in a motor vehicle while requiring minimal hardware.

Yet, a further object of the present invention is to provide for a purge flow monitor which accurately tests the purge flow in a motor vehicle in a low cost and efficient manner to insure that the evaporative emission control purge flow system is operating properly.

SUMMARY OF THE INVENTION

In order to achieve the foregoing objectives, the present invention provides a system and method of monitoring evaporative emission control purge flow in a motor vehicle. A condition indicative of purge flow operation activation is identified. One or more combustion related signals indicative of combustion in an engine of the motor vehicle are measured. Preferably, these combustion related signals include an engine idle speed signal, an engine speed signal and a fuel control signal. The amount of purge flow is increased, preferably according to a ramped programmable rate, and a change in any one of the combustion related signals is determined. A determination of whether purge flow is present is made based on the determined change in one or more of the combustion related signals.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENT

Figure 1:
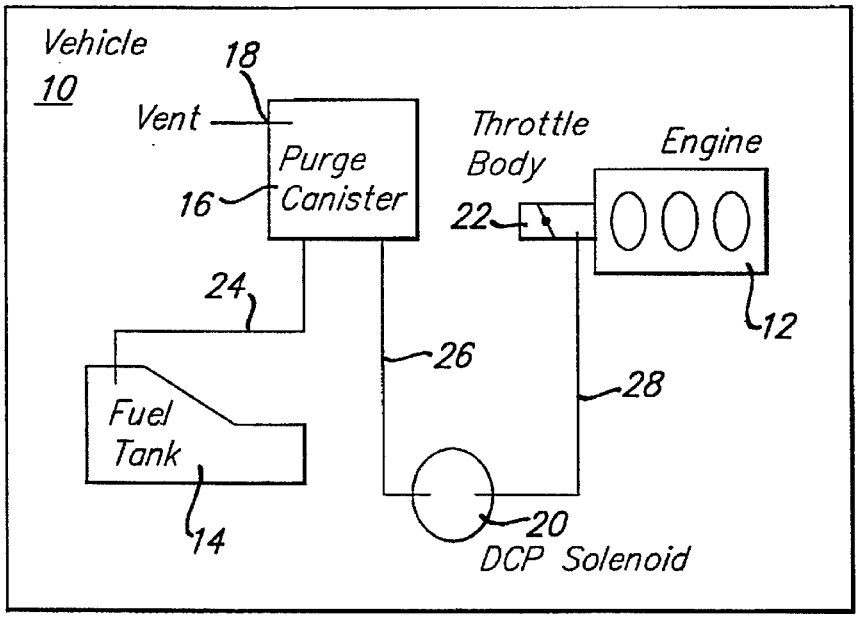
FIG. 1 is a block diagram illustrating an evaporative emission control system equipped with purge flow in a motor vehicle.

Turning now to FIG. 1, an evaporative emission control (EEC) purge flow system is shown for purging gasoline vapors from a fuel tank 14 in a motor vehicle 10. The purge flow system includes a conventional purge canister 16 for collecting vapors produced from evaporation of hydrocarbon based fluids. Purge canister 16 preferably includes an activated charcoal canister to collect and trap gasoline vapors from the fuel tank 14, especially when the engine 12 is shut off. The purge canister 16 is equipped with a vent 18 which allows air intake when opened. A first purge flow line 24 provides an air flow passage between the fuel tank 14 and purge canister 16. A second purge flow line 26 provides an air flow passage between the purge canister 26 and an electronic controlled duty cycle purge (DCP) solenoid valve 20. A third purge flow line 28 provides an air flow passage between the solenoid valve 20 and an engine throttle body inlet 22, preferably through the intake manifold (not shown), to allow air and vapors to be injected into the engine 12 for burning therein.

The purge flow system illustrated herein is configured to purge gasoline vapors collected from the fuel tank 14 and carburetor of the motor vehicle 10. The collected vapors pass through first purge flow line 24 and accumulate in the charcoal purge canister 16 when the engine 12 is shut off. This usually occurs with vent 18 open. The collection of these vapors reduces or prevents evaporative vapors from leaking from the motor vehicle 10 into the environment. The electronic controlled solenoid valve 20 permits a manifold vacuum to be created in the purge flow lines 24, 26 and 28 in cooperation with vent 18 so as to purge the collected evaporative emissions from the charcoal purge canister 16. Therefore, on restarting of the internal combustion engine 12, the purge flow system causes a flow of filtered air into open vent 18 through the charcoal purge canister 16 to purge the collected vapors from the charcoal purge canister 16. The air flow mixture of air and vapors then passes through purge flow lines 26 and 28 and duty cycle purge solenoid valve 20 and into the throttle body 22 and the intake manifold for burning in the engine 12.

Figure 2:
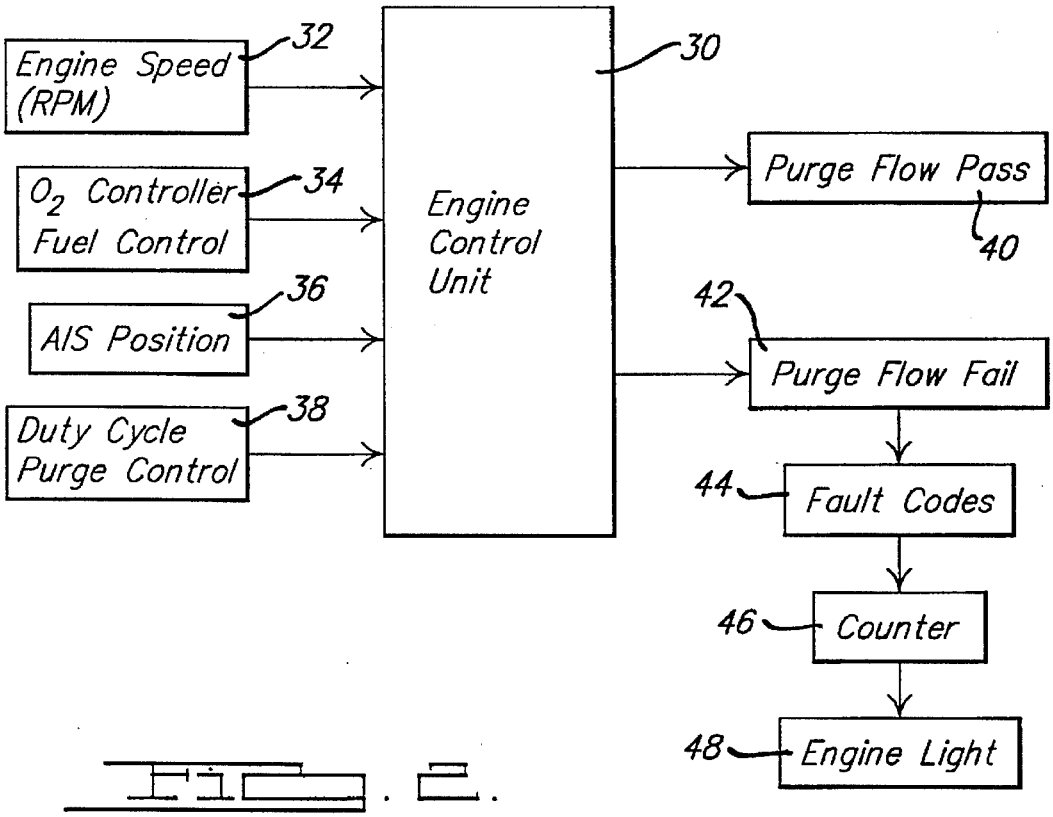
FIG. 2 is a block diagram illustrating control inputs and outputs for monitoring purge flow with the present invention.

In accordance with the present invention, the purge flow system is monitored and a determination is made as to whether the purge flow system is operating properly by determining the presence of purge flow. Referring to FIG. 2, the purge flow monitor measures engine combustion related parameters and makes a determination as to whether or not purge flow passes or fails a purge flow monitor test as will be described hereinafter. To process measured combustion related signals in accordance with the purge flow monitor test, engine control unit 30 receives the measured signals as inputs. These signals preferably include a signal indicative of engine speed (RPM) 32, a signal from the oxygen controller indicative of fuel control 34 and a signal indicative of the automatic idle speed (AIS) position 36. Input signals 32, 34 and 36 are all related to combustion of the engine 12. Additionally, engine control unit 30 receives a duty cycle purge control signal 38 as an input. Duty cycle purge control signal 38 provides an indication of whether purge flow is activated through opening of the solenoid valve 20 and further provides an indication of the position of solenoid valve 20.

In response to input signals 32–38, engine control unit 30 makes a determination as to whether or not purge flow is present and therefore passes the purge flow monitor test. Accordingly, engine control unit 30 produces a purge flow pass output signal 40 or a purge flow fail output signal 42. When the purge flow fail output signal 42 is provided, fault codes 44 are set and a counter 46 keeps track of the number of fault codes so as to monitor of the number of purge flow monitor test fail signals. Accordingly, the purge flow monitor can keep track of the number of times the purge flow system fails the test and this information can be used to diagnose any problems which may occur with the purge flow system. Additionally, engine light 48 or other purge flow fail indicator can be energized upon reaching the occurrence of a minimum number of determined failures. This provides the driver of the motor vehicle 10 with notice of a potential purge flow problem.

The purge flow system monitor of the present invention is a two stage detection strategy for determining the presence of purge flow within the evaporative emission control purge flow system. The first stage of the purge flow monitor identifies the presence of purge flow through a measurement of the corruption of closed-loop fuel correction factors. This can be achieved by checking the appropriate zap flags which identify high levels of purge flow in the system. The zap flags typically include three flags located in the long term adaptive memory. A comparison of updated purge and purge free fuel adaptive cells is performed and if a significant difference between the cells is obtained, the purge flow system is assumed to be functional. This is because one or more of the zap flags being set is indicative of high levels of purge flow present in the system.

If none of the zap flags are set, the purge flow monitor proceeds to the second stage (e.g., stage II) of the test. The strategy of the second stage of the purge flow monitor is to identify purge flow by a measure of change in automatic idle speed, engine speed or fuel control with a ramp-in of the purge duty cycle solenoid valve 20 during a steady-state idle condition. In effect, stage II looks for changes in engine operation during a change in purge flow control which would indicate the presence of purge flow. Purge flow control is achieved by controlling the solenoid valve 20.

Figure 3:
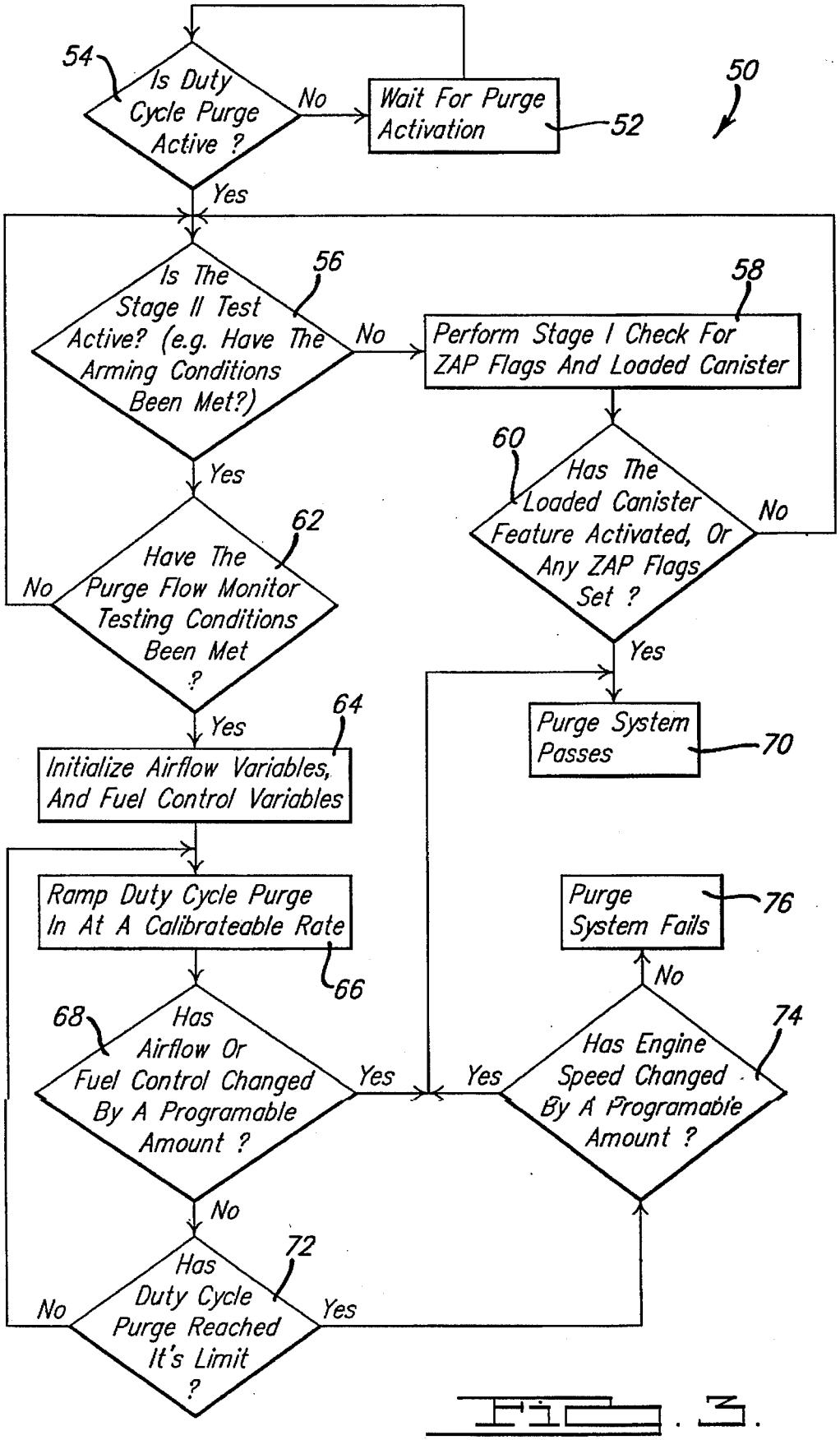
FIG. 3 is a flow diagram illustrating a methodology of monitoring purge flow in a motor vehicle according to the present invention.

With particular reference to FIG. 3, a methodology 50 of monitoring the purge flow system and determining whether the purge flow is operating properly according to the second stage of the test is illustrated therein. Purge flow monitor methodology 50 begins with step 52 which waits for an indication that purge flow is active. Test block 54 determines if the duty cycle purge is active. If it is determined that purge flow is not activated, the methodology 50 continues to wait for purge activation pursuant to step 52. With the duty cycle purge activated, methodology 50 proceeds to test block 56 which determines whether stage II of the monitoring test is active. For the stage II test to be active, a number of precedent arming conditions must be met. These arming conditions are provided in Table 1 below:

TABLE 1

| Calibratable period of time has elapsed following completion of a selected interfering OBD II test |
|---|
| Engine operating within idle fuel adaptive cell |
| Closed throttle |
| Operating in fuel run mode |
| AIS start-up kick complete |
| Not in AIS limp-in |
| Not in deceleration |
| AIS delay timer complete |
| Period of time has elapsed since engine start-up |
| Reached minimum coolant temperature |
| Absolute difference between engine RPM and target idle RPM is less than minimum value |
| Manifold pressure less than a set value |
| AIS motor not moving |
| Barometric pressure exceeds a minimum valve |
| Duty cycle purge multiplier set to at least a minimum value |
| Ambient temperature exceeds temperature limit |
| Vehicle speed less than set speed |

Provided the stage II test is active pursuant to step 56 and the conditions found in Table 1 are satisfied, methodology 50 proceeds to test block 62 which determines whether a set of purge flow monitor testing conditions are concurrently being met. The conditions that must be met throughout the Stage two test are provided below in Table 2:

TABLE 2

| |
|---|
| No change in A/C state |
| Increasing AIS position |
| Engine operating within idle fuel adaptive cell |
| Closed throttle |
| Operating in fuel run mode |
| Not in AIS limp-in |
| Not in deceleration |
| Coolant temperature exceeds minimum value |
| Engine RPM within predefined limits |
| No change in P/S switch |
| No change in state for cooling fans |

If the above set of conditions provided in Table 2 have not been met, methodology 50 returns to test block 56 to determine whether the stage II test is active. With the stage II test determined not to be active, step 58 will perform the first stage test thereby checking for the zap flags and also checking for a loaded canister. Next, test block 60 determines whether the loaded canister feature is activated or any zap flags are set. If not, the methodology 50 returns to test block 56 to determine if the stage II test is active. If either the loaded canister feature is activated or any of the zap flags are set, the purge system monitor determines that the purge system passes the test as provided in step 70.

Returning to step 62, if the purge flow monitor testing conditions have been met, the air flow variables and fuel control variables are initialized pursuant to step 64. Thereafter, purge flow is ramped in at a duty cycle in accordance with a constant programmable rate as provided in step 66. Test block 68 will then check to see if air flow or fuel control has changed by a programmable amount and, if so, methodology 50 will determine the purge system passes pursuant to step 70. If the air flow or fuel control has not changed by a programmable amount, test block 72 will determine if the duty cycle purge has reached its limit. If the limit has been reached, methodology 50 returns to step 66 to ramp-in the purge flow at the constant programmable rate. If the duty cycle purge has reached its limit, test block 74 determines if the engine speed has changed by a programmable amount. If engine speed has changed by a programmable amount the methodology 50 determines that the purge system passes pursuant to step 70. Otherwise, if engine speed has not changed by the programmable amount the purge system then fails the test pursuant to step 76.

The purge flow monitor is preferably activated to test purge flow at least one time per vehicle start up and use, while the purge flow system remains on at all times. If the purge flow monitor test has failed, the test failure counter 46 is incremented so that the number of test failures are counted. The purge flow monitor test will continue to test for purge flow until the purge flow test passes or a maximum number of attempts have been made. Once the predetermined maximum number of attempts are reached, the fault code 44 is set and stored in memory and engine light 48 may be energized. If the test passes, the purge flow monitor test is complete for the current vehicle use.

It should be appreciated that the purge flow monitor system and method of the present invention advantageously monitors purge flow in an evaporative emission control system of a motor vehicle to determine whether the purge flow system is operating properly. It should be appreciated that the monitor may check a limited portion of the purge flow system according to a non-strict monitoring requirement, or the monitor may check the entire purge flow system according to a more strict evaporative monitor test. Generally speaking, the non-strict evaporative monitor may check for airflow blockage within the second purge flow line 26, duty cycle purge solenoid valve 20 and third purge flow line 28. The non-strict evaporative purge flow monitor may also check for a leakage opening in the solenoid valve 20 and third purge flow line 28.

According to the more strict evaporative monitoring requirement, purge flow is monitored throughout the entire purge flow system. This includes monitoring for airflow blockages or leakage openings anywhere from the fuel tank 14 to the engine 12, including respective first, second and third purge flow lines 24, 26 and 28, purge canister 16 and solenoid valve 20. The type of purge flow monitor employed may depend on the given motor vehicle and the emission requirements that are to be met.

The purge flow monitor of the present invention may advantageously be employed in combination with a leak detection pump for detecting leaks within the purge flow system. This is especially true when used in accordance with the more strict evaporative monitoring requirements. In doing so, vent 18 may be closed to detect the presence of a leak internal to the system. At the same time, the purge flow monitor may also detect for the presence of purge flow within the purge flow system.

While a specific embodiment of the invention has been shown and described in detail to illustrate the principles of the present invention, it will be understood that the invention may be embodied otherwise without departing from such principles. For example, one skilled in the art will readily recognize from such discussion and from the accompanying drawings and changes that various changes, modifications and variations can be made therein without departing from the spirit and scope of the present invention as described in the following claims.

What is claimed is:

1. A method of monitoring purge flow for evaporative emission control in a motor vehicle, said method comprising the steps of:

identifying a condition indicative of purge flow activation;

monitoring one or more combustion related signals indicative of combustion in an engine of the motor vehicle;

changing purge flow control at a determined ramped rate;

determining a change in said one or more combustion related signals when said purge flow control is changing at the ramped rate; and determining the presence of purge flow as a function of said determined change in the one or more combustion related signals.

2. The method as defined in claim 1 wherein said step of monitoring the one or more combustion related signals comprises:

measuring a first signal indicative of idle speed of the engine;

measuring a second signal indicative of engine speed; and measuring a third signal indicative of fuel control.

3. The method as defined in claim 1 wherein said step of changing purge flow control comprises increasing purge flow control in accordance with the ramped rate.

4. The method as defined in claim 1 wherein an amount of change in any one of said one or more combustion related signals indicates proper operation of the purge flow system.

5. The method as defined in claim 1 further comprising the step of determining the presence of purge flow as a function of purge zap flags.

6. A method of monitoring purge flow for evaporative emission control in a motor vehicle, said method comprising the steps of:

identifying a condition indicative of purge flow operation activation;

measuring a signal indicative of idle speed of the engine;

measuring a signal indicative of engine speed;

measuring a signal indicative of fuel control;

increasing an amount of purge flow control in accordance with determined ramping rate;

determining a change in any of said idle speed signal, engine speed signal and fuel control signal while the purge flow control in increased in accordance with the ramping rate; and determining a presence of purge flow based on said determined change in said signals.

7. The method as defined in claim 6 wherein an amount of change in any one of said engine speed, fuel control and idle speed signals indicates proper operation of the purge flow system.

8. A method of monitoring purge flow for evaporative emission control in a motor vehicle, said method comprising the steps of:

identify a condition indicative of purge flow operation activation;

measuring a signal indicative of engine speed;

increasing an amount of purge flow control in accordance with a determined ramping rate;

determining a change in the engine speed during said increase in the amount of purge flow control; and determining a presence of purge flow based on of the determined change in engine speed.

9. A method of monitoring purge flow for evaporative emission control in a motor vehicle, said method comprising the steps of:

identify a condition indicative of purge flow operation activation;

measuring a signal indicative of idle speed of an engine;

increasing an amount of purge flow control in accordance with a determined ramping rate;

determining a change in the idle speed during the increase in the amount of purge flow control; and determining a presence of the purge flow based on the determined change in idle speed.

10. A method of monitoring purge flow for evaporative emission control in a motor vehicle, said method comprising the steps of:

identify a condition indicative of purge flow operation activation;

measuring a signal indicative of fuel control;

increasing an amount of purge flow control in accordance with a determined ramping rate;

determining a change in the fuel control during the increase in the amount of purge flow control; and determining a presence of purge flow based on the determined change in fuel control.

11. A system for monitoring purge flow for evaporative emission control in a motor vehicle, said system comprising:

means for identifying the presence of purge flow;

means for measuring an idle speed signal;

means for measuring an engine speed signal;

means for measuring a fuel control signal;

a controller for changing purge flow control; and means for determining presence of purge flow based on changes in any one or more of said idle speed signal, engine speed signal and fuel control signal.

12. The system as defined in claim 11 further comprising a control valve for changing purge flow control by increasingly opening a valve according to a ramping rate.

13. A system for monitoring purge flow for evaporative emission control in a motor vehicle, said system comprising:

means for identifying the presence of purge flow;

means for measuring one or more combustion-related signals indicative of combustion in an engine of the motor vehicle;

a control valve for controlling purge flow;

a controller for increasing purge flow control through the control valve in accordance with a ramping rate; and means for determining presence of purge flow based on a change in said one or more combustion-related signals.

14. A system for monitoring purge flow in an evaporative emission control system in a motor vehicle, said system comprising:

a canister for collecting evaporative emissions, said canister including a vent;

a leak detection pump including a means for sealing the vent of the canister;

a control valve for controlling purge flow;

a controller for controlling the control valve so as to change purge flow in accordance with a ramping rate;

means for measuring a combustion related signal during the change in purge flow control and determining a change in said measured signal; and means for determining purge flow as a function of the change in said signal during the change in purge flow control.

* * * * *